United States Patent [19]

Ishihara

[11] Patent Number: 4,998,015

[45] Date of Patent: Mar. 5, 1991

[54] MASS SPECTROMETER CAPABLE OF MULTIPLE SIMULTANEOUS DETECTION

[75] Inventor: Morio Ishihara, Tokyo, Japan

[73] Assignee: JEOL Ltd., Tokyo, Japan

[21] Appl. No.: 379,561

[22] Filed: Jul. 13, 1989

[30] Foreign Application Priority Data

Jul. 14, 1988 [JP] Japan ..... 63-176092

[51] Int. Cl.[5] ..... H01J 49/32

[52] U.S. Cl. ..... 250/299; 250/298; 250/300; 250/396 R; 250/397

[58] Field of Search ..... 250/299, 298, 296, 396 R, 250/396 ML, 300

[56] References Cited

U.S. PATENT DOCUMENTS

| | | | |
|---|---|---|---|
| 3,217,161 | 11/1965 | Craig | 250/296 |
| 3,524,056 | 8/1970 | Enge et al. | 250/299 |
| 4,078,176 | 3/1978 | Matsuda | 250/299 |
| 4,174,479 | 11/1979 | Tuithoj et al. | 250/299 |
| 4,303,864 | 12/1981 | Crewe et al. | 250/396 R |
| 4,367,411 | 1/1983 | Hanley et al. | 250/396 ML |
| 4,389,571 | 6/1983 | Crewe | 250/396 R |
| 4,414,474 | 11/1983 | Crewe | 250/396 R |
| 4,424,090 | 5/1990 | Wallnik et al. | 250/296 |
| 4,435,642 | 3/1984 | Neugebauer et al. | 250/296 |
| 4,472,631 | 9/1984 | Enke et al. | 250/281 |
| 4,638,160 | 1/1987 | Slodzian et al. | 250/296 |
| 4,743,756 | 5/1988 | Krivanek | 250/396 R |
| 4,767,930 | 8/1988 | Stieber et al. | 250/396 R |
| 4,851,670 | 7/1989 | Krivanek | 250/396 ML |

*Primary Examiner*—Jack I. Berman

*Assistant Examiner*—Kiet T. Nguyen

*Attorney, Agent, or Firm*—Webb, Burden, Ziesenheim & Webb

[57] ABSTRACT

There is disclosed a mass spectrometer capable of multiple simultaneous detection. The operation mode of the instrument can be switched between a mode in which a wide mass range is obtained and another mode in which high resolution is obtained. The spectrometer includes a mass analyzer having at least a sector magnetic field and a two-dimensional ion detector placed along a focal plane of the analyzer. The detector detects simultaneously ions focused and dispersed by the analyzer according to mass-to-charge ratio. A lens means having variable magnitude is disposed in the ion path between the magnetic field and the detector. A position-adjusting means places the detector along the focal plane which differs, depending upon the magnitude of the lens means. There is further disclosed a mass spectrometer which is capable of multiple simultaneous detection and includes said lens means and a lens magnitude-varying means. In this instrument, the lens means consists of two quadrupole lenses arranged in series. The lens magnitude-varying means causes the quadrupole lenses to assume one of predetermined sets of magnitudes such that the intersection of the central orbit or ions and the ion focal plane is not moved, irrespective of changes in the magnitudes of the lenses. A rotating mechanism is needed to rotate the detector about the intersection. The rotating mechanism can be dispensed with by using a sextupole lens in conjunction with the quadrupole lenses.

2 Claims, 4 Drawing Sheets

MASS SPECTROMETER CAPABLE OF MULTIPLE SIMULTANEOUS DETECTION

FIELD OF THE INVENTION

The present invention relates to a mass spectrometer capable of multiple simultaneous detection, using a two-dimensional ion detector having spatial resolution and, more particularly, to a mass spectrometer whose operation mode can be switched between a mode in which masses can be measured in a wide range and a mode in which high resolution can be obtained.

BACKGROUND OF THE INVENTION

Mass spectrometers equipped with a two-dimensional ion detector and capable of multiple simultaneous detection are disclosed, for example in U.S. Pat. Nos. 4,435,642, 4,472,631, and 4,638,160.

FIG. 1 shows a mass spectrometer capable of such simultaneous detection. The spectrometer includes an ion source 1 producing ions. The ions are separated and focused along a focal plane ( according to their mass-to-charge ratios by a mass analyzer consisting of a cylindrical electric field 2 and a uniform magnetic sector 3. In order to detect the separated ions simultaneously, a two-dimensional ion detector 4 having spatial resolution is disposed along the focal plane l.

The detector 4 makes use of a microchannel plate or an array of minute semiconductor detectors.

The range $\Delta M$ in which the detector can detect masses simultaneously is given by $$\Delta M = |M_b - M_a| = (L/A_\gamma)M_o \quad (1)$$

where $M_o$ is the mass of the ion following the central orbit O of ions., $M_a$ is the mass of the ion impinging on one end of the detector 4, $M_b$ is the mass of the ion impinging on the other end of the detector 4, L is the length of the detector 4, and $A_\gamma$ is the mass dispersion of the spectrometer. The mass resolution R determined by the detector 4 is given by $$R \leqq \frac{d}{L} \cdot \frac{M_o}{\Delta M} = \frac{A\gamma}{\alpha} \quad (2)$$

where d is the spatial resolution of the detector 4.

Usually, the length L and the spatial resolution d are determined by the selected detector and so they cannot be selected at will. As an example, if the mass dispersion $A_\gamma$ is reduced to enlarge the range of masses in accordance with equation (1), then the resolution deteriorates as dictated by equation (2). Therefore, the instrument designer has had to strike an appropriate compromise between these two conflicting requirements, i.e., mass range and resolution.

SUMMARY OF THE INVENTION

It is an object of the present invention to provide a mass spectrometer that is capable of multiple simultaneous detection and can be switched between a first mode in which priority is given to mass range and a second mode in which priority is given to resolution.

It is another object of the invention to provide a mass spectrometer that is capable of multiple simultaneous detection and can be switched between the first and second modes described in the preceding paragraph without moving the detector.

In one embodiment of the invention, a lens means having variable magnitude is disposed in the ion path between a mass analyzer and a two-dimensional ion detector. Further, there is provided a detector-moving means to place the two-dimensional ion detector along a different focal plane, depending on different magnitudes of the lens means.

In another embodiment of the invention, a lens means consists of a series combination of two quadrupole lenses. There is provided a mechanism for rotating the detector.

In a further embodiment of the invention, a sextupole lens is disposed between a magnetic field forming a mass analyzer and a two-dimensional ion detector. No detector-moving means is provided.

DESCRIPTION OF THE PREFERRED EMBODIMENTS

Figure 1:
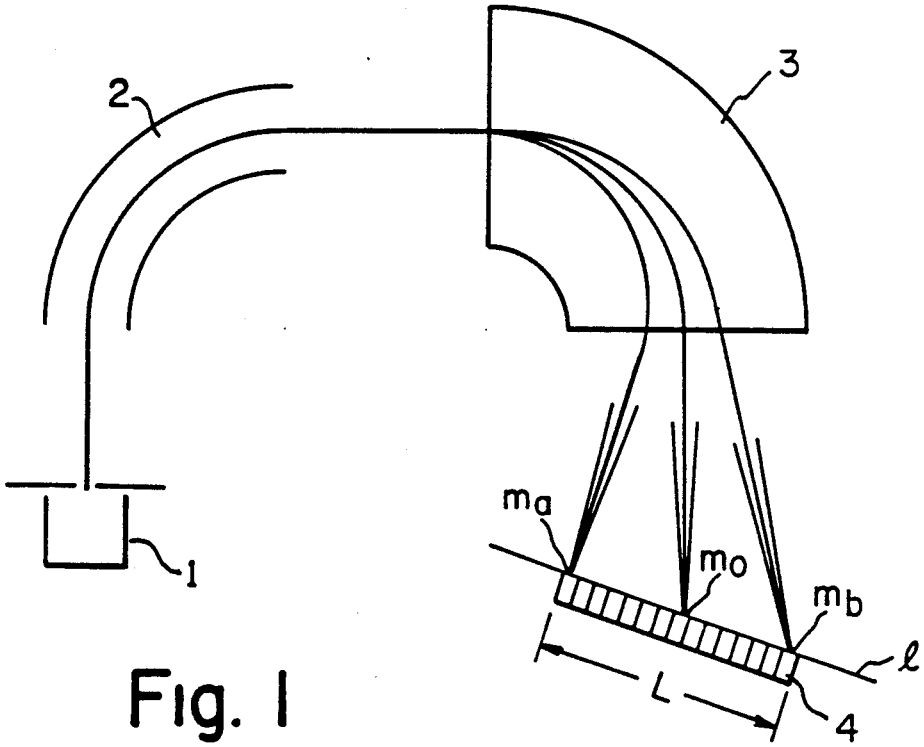
Fig. 1 PRIOR ART
FIG. 1 is a diagram of the ion optics of a coventional mass spectrometer equipped with a two-dimensional ion detector and capable of multiple simultaneous detection.
Figure 2:
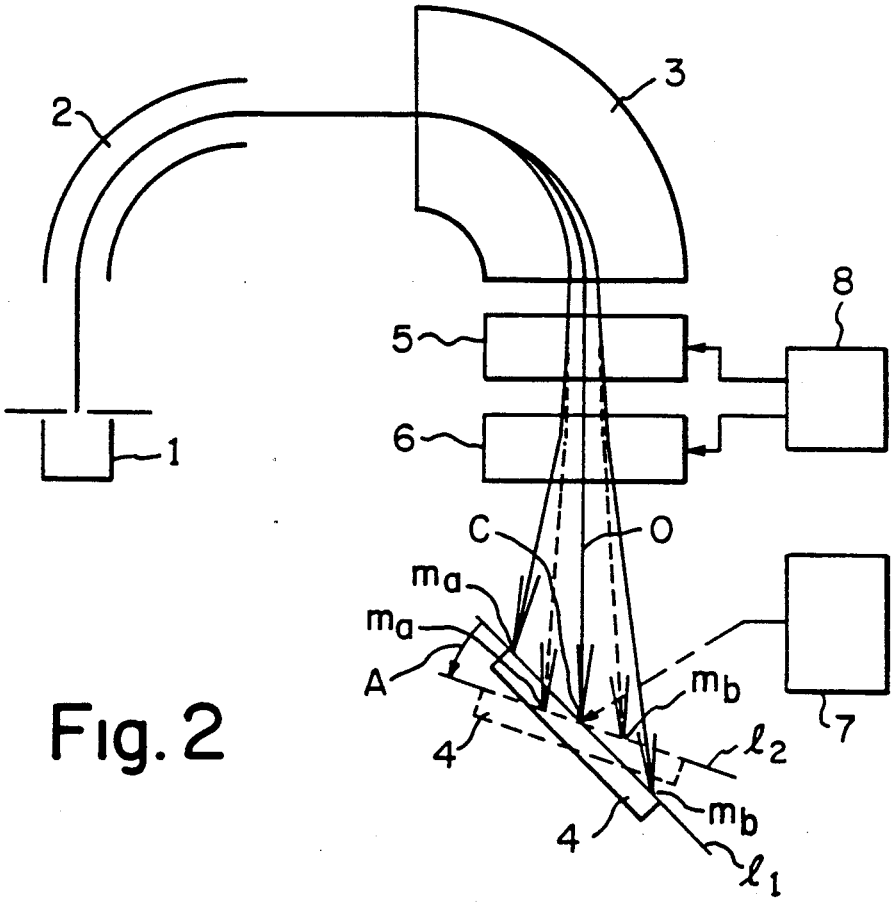
FIG. 2 is a diagram of the ion optics of a mass spectrometer according to this invention.

Referring to FIG. 2, there is shown the ion optics of a mass spectrometer according to the present invention. This spectrometer is similar to the conventional instrument shown in FIG. except that quadrupole lenses 5, 6, a lens magnitude control circuit 8, and a rotating mechanism 7 are added.

The quadrupole lenses 5 and 6 are arranged in series in the ion path between a magnetic sector 3 and an ion detector 4. The lens magnitude control circuit 8 varies the magnitudes $Q_1$ and $Q_2$ of the quadrupole lenses 5 and 6, respectively, utilizing predetermined sets of magnitudes. The rotating mechanism 7 rotates the ion detector 4 as indicated by the arrow A about the intersection of the detector 4 and the central orbit O of ions.

It is now assumed that the quadrupole lenses 5 and 6 have magnitudes $Q_{11}$ and $Q_{21}$, respectively. Under this condition, a focal plane $l_1$ is formed. The mass dispersion is given by $A_{\gamma 1}$. The intersection of the focal plane ll and the central orbit O, or ion optical axis, of ions is given by C. We then assume that when the lenses have magnitudes $Q_{12}$ and $Q_{22}$, respectively, a focal plane $l_2$ is formed.

At this time, the magnitudes $Q_{12}$ and $Q_{22}$ can be so set that the intersection of the focal plane $l_2$ and the central orbit O lies at C, for the following reason. The magnitudes $Q_1$ and $Q_2$ of the quadrupole lenses 5 and 6 can be set at will. The relation between the magnitudes $Q_1$ and $Q_2$ is uniquely determined, provided that the focal point lies at C. For example, if the magnitude $Q_1$ is set, then the magnitude $Q_2$ is uniquely determined. Generally, the focal planes $l_1$ and $l_2$ are not the same. Also, the mass dispersion $A_{\gamma 1}$ differs from the mass dispersion $A_{\gamma 2}$ in the focal plane $l_2$.

Therefore, the mass dispersion $A_\gamma$ can be set arbitrarily within a given range by changing the magnitudes $Q_1$ and $Q_2$. If the mass dispersion $A_\gamma$ is increased, the mass range is narrowed, but the resolution is enhanced. If the mass dispersion $A_\gamma$ is reduced, the resolution decreases, but the mass range can be extended. Various sets of magnitudes $Q_1$ and $Q_2$, such as ($Q_{11}$, $Q_{21}$) and ($Q_{12}$, $Q_{22}$), which provide different degrees of mass dispersion but do not move the intersection of the focal plane and the ion optical axis are stored in the lens magnitude control circuit 8. The magnitudes of the quadrupole lenses 5 and 6 are set to $Q_{11}$, $Q_{21}$ or $Q_{12}$, $Q_{22}$ under the operator's instruction. When the lens magnitudes are $Q_{11}$ and $Q_{21}$, the rotating mechanism 7 adjusts the angle of the detector 4 so that the detector 4 is positioned along the focal plane $l_1$, according to the discrimination signal from the lens magnitude control circuit 8. When the magnitudes are $Q_{12}$ and $Q_{22}$, the angle of the detector 4 is adjusted to place the detector along the focal plane $l_2$. In this example, if the detector 4 is placed along the focal plane $l_1$, the range $\Delta M$ is covered by the whole length of the detector. If the detector is placed along the focal plane $l_2$, a range exceeding $\Delta M$ is covered. Accordingly, the former case gives a high-resolution mode, while the latter offers a wide mass range mode. Since the two quadrupole lenses are disposed in the field-free region formed ahead of the detector, any set of the magnitudes $Q_1$ and $Q_2$ satisfies the energy focusing condition, provided that direction focusing occurs at point C.

Figure 3:
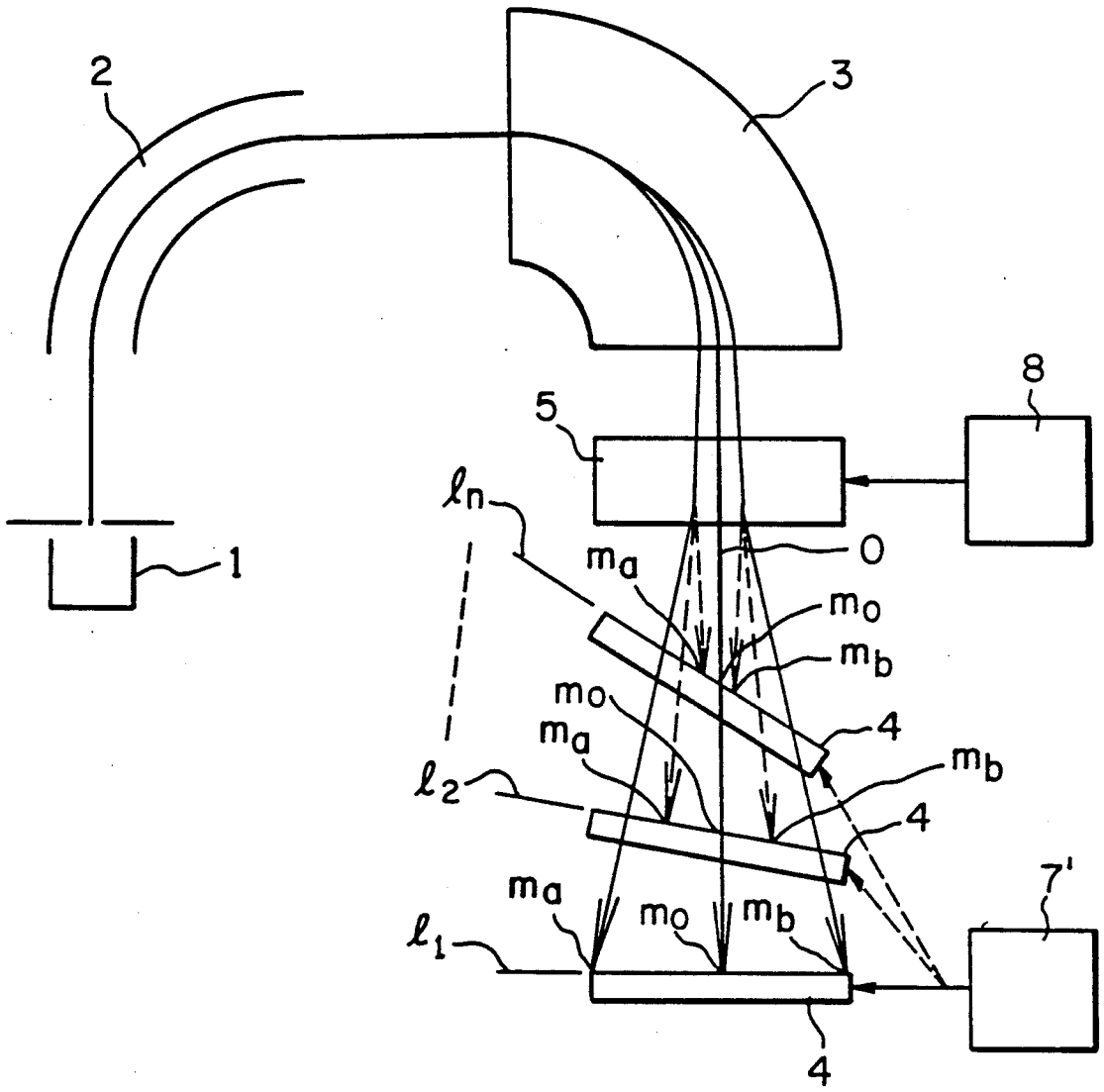
FIG. 3 is a diagram of the ion optics of another mass spectrometer according to the invention.

FIG. 3 shows another mass spectrometer, and in which only a single quadrupole lens 5 is disposed. When the magnitude of the quadrupole lens 5 is varied by the lens magnitude control circuit 8, the focal plane moves from $l_1$ to $l_2$ and then to $l_3$, and so on. Finally, it reaches $l_n$. The intersection of the focal plane and the central orbit of ions also shifts. That is, it is impossible to prevent the intersection from moving, because only one lens is used. However, the mass dispersion $A_\gamma$ can be changed by changing the lens magnitude. This enables one to select either a measurement in which importance is attached to the measured mass range or a measurement in which importance is attached to the resolution. A moving mechanism 7' is provided to move the ion detector 4 in response to the movement of the focal plane. As an example, the moving mechanism 7' changes the position and the orientation of the detector 4 continuously or in a stepwise fashion along an appropriate guide member.

It is also possible to place plural ion detectors in a predetermined focal plane and to selectively use the detectors according to the magnitude of the quadruple lens 5. In this case, it is necessary to move the front detector off the ion path, for preventing the front detector from obstructing the rear detector when the rear detector is employed. In this configuration, it is only necessary to slightly move the front detector. Hence, the moving mechanism can be made simple.

Figure 4:
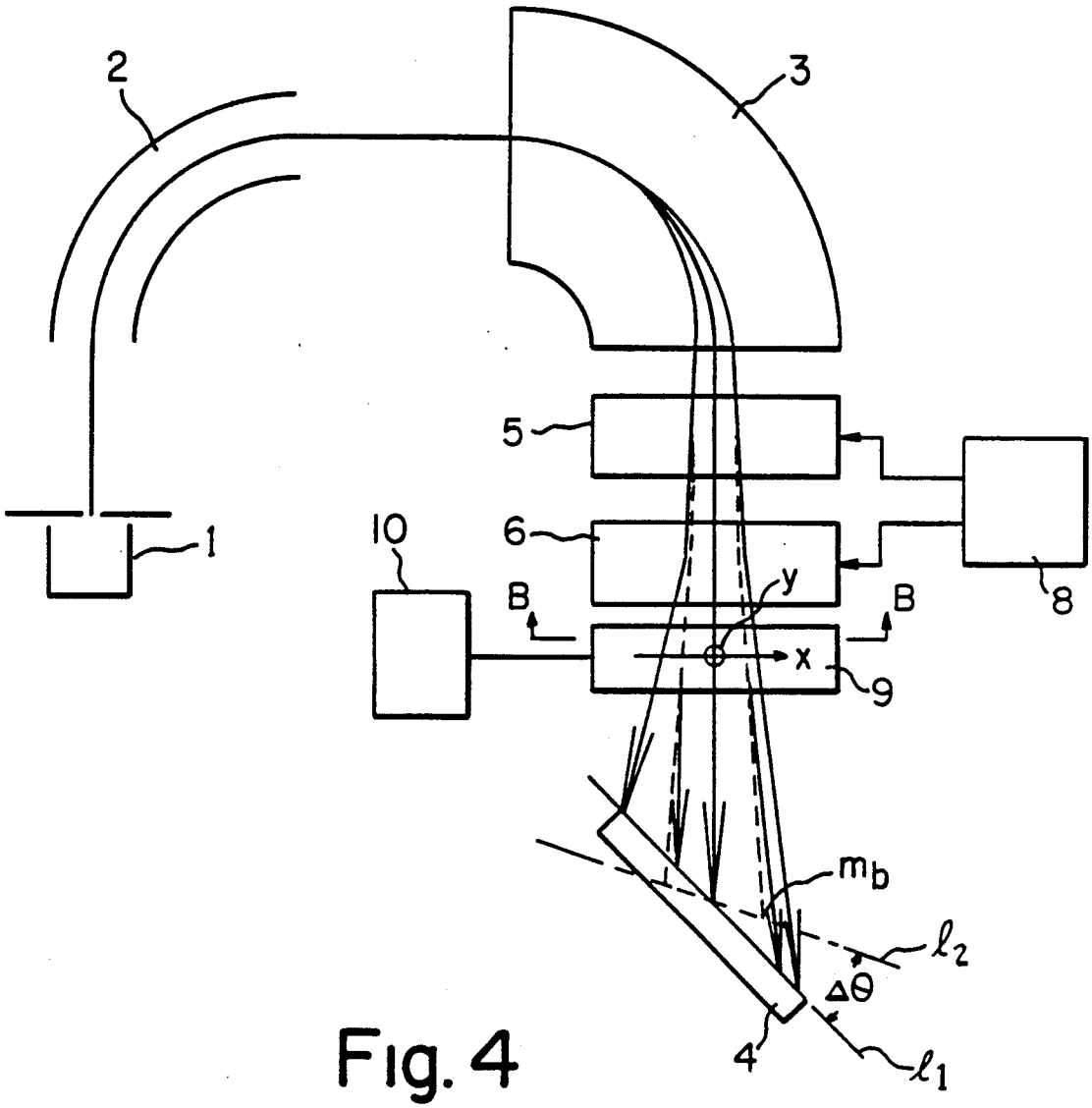
FIG. 4 is a diagram of the ion optics of a further mass spectrometer according to the invention.
Figure 5:
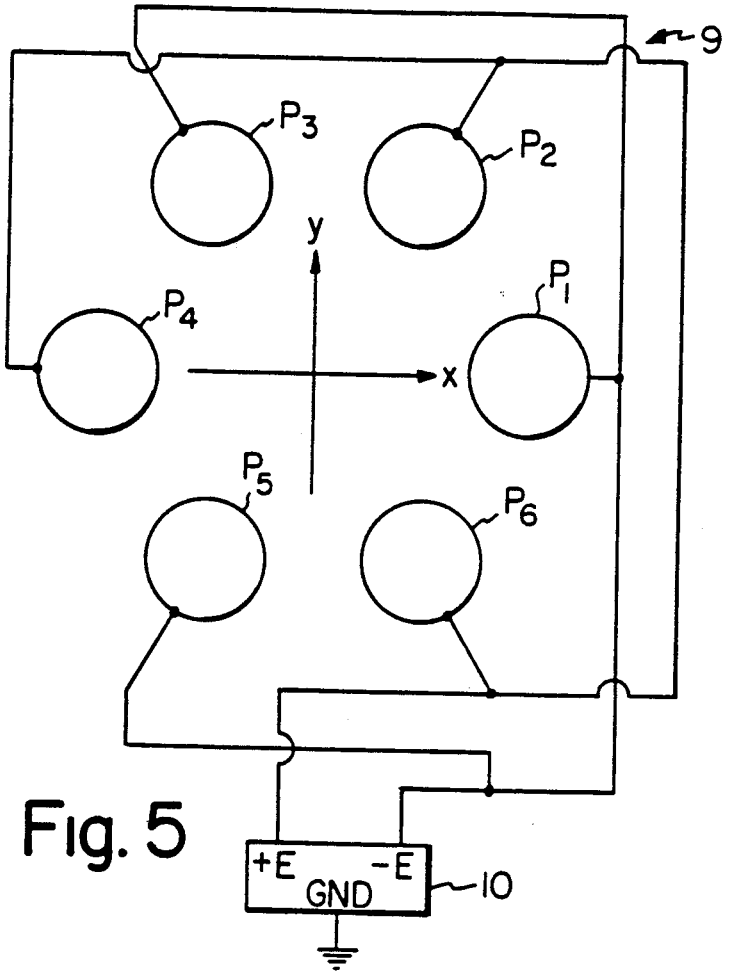
FIG. 5 is a diagram taken along line B—B of FIG. 4, for showing a sextupole lens 9.

FIG. 4 is a diagram of the ion optics of a further mass spectrometer according to the invention. This spectrometer is similar to the spectrometer shown in FIG. 2 except that a sextupole lens 9 and a lens magnitude control circuit 10 are added and that the rotating mechanism is omitted. The sextupole lens 9 is placed at an arbitrary position in the ion path between the magnetic field 3 and the two-dimensional ion detector 4. FIG. 5 is a cross-sectional view taken on line B-B of FIG. 4, for showing the sextupole lens 9. In FIG. 5, the sextupole lens 9 consists of six cylindrical electrodes $P_1$–$P_6$ circumferentially regularly spaced 60° from each other. The control circuit 10 applies voltages +E and −E to each electrode.

The action of the sextupole lens 9 is now described. The sextupole lens placed as shown in FIG. 5 produces a sextupole electric field. In this field, the potential V at an arbitrary position (x, y) in the x-y plane vertical to the central orbit O of the ion beam is given by $$V(x, y) = h(x^3 - 3X y^2) \quad (1)$$

where h is a coefficient proportional to the voltage applied to the lens electrode. In the orbit plane (y=0) in which ions are dispersed according to mass, equation (1) is simplified into the form $$V(x) = H x^3 \quad (2)$$

If the potential expressed by equation (2) is given to the electric field, the force F (x) that ions having charge e and traveling through this field receive is given by $$F(x) = -e[d V(x)/d x] = -3eh x^2 \quad (3)$$

Let us consider the effect of the lens on the ion beam distributed about x=0. The effect is proportional to the first-order change rate, i.e., the force F (x) with respect to the position. Therefore, the lens effect near $x - x_0$ is given by $$[d F(x)/d x]_{x=x_0} = -6eh x_0 \quad (4)$$

Figure 6A:
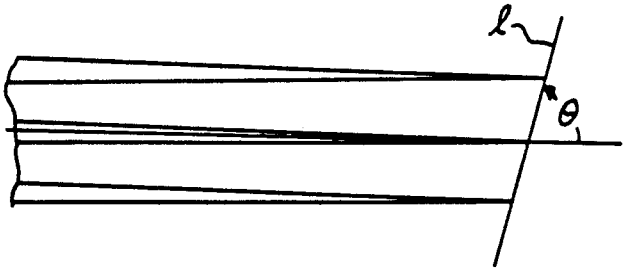
FIGS. 6(*a*) and 6(*b*) are diagrams illustrating rotation of a focal plane made by the sextupole lens shown in FIG. 5.
Figure 6B:
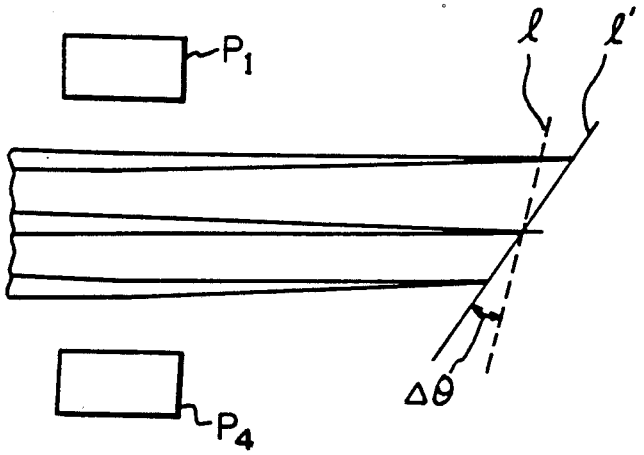

Equation (4) shows that the intensity of the effect of the sextupole lens is in proportion to the distance from the central axis (x=0). It is possible, therefore, to vary the focal length in proportion to the distance from the central axis.

Where the ion focal plane l is inclined at angle $\theta$ to the central orbit O of the ion beam as shown in FIG. 6(*a*), if the sextupole lens is mounted as shown in FIG. 6(*b*), then the focal plane is rotated through $\Delta\theta$. This brings the focal plane into position l'. In this way, the sextupole lens can rotate the focal plane about the ion central orbit through an angle determined by the coefficient h. This coefficient h can be varied by varying the voltage applied to the lens electrodes $P_1$–$P_6$. If the polarity of the voltage applied to the lenses is inverted, then the coefficient h is inverted in sign. Also, the direction of rotation is inverted.

In the example shown in FIG. 4, the ion detector 4 is fixed at the position indicated by the solid line in FIG. 2. The lens magnitude control circuit 8 sets the magnitudes of the quadrupole lenses 5 and 6 either to $Q_{11}$, $Q_{21}$ for high-resolution mode or to $Q_{12}$, $Q_{22}$ for wide mass range mode under the operator's instruction, in the same way as in the example shown in FIG. 2. If the sextupole lens 9 does not exist, the focal plane assumes position $l_1$ in the high-resolution mode and position $l_2$ in the wide mass range mode, in the same manner as in the example shown in FIG. 2. In the present example, the ion detector 4 is fixedly placed along the focal plane $l_2$. The sextupole lens 9 is energized by the control circuit 10 so that the coefficient h takes value $h_1$ (=0) in the high-resolution mode and value $h_2$ in the wide mass range mode as shown in Table 1.

TABLE 1

| | mode | |
|---|---|---|
| | high resolution | wide mass range |
| $Q_1$ | $Q_{11}$ | $Q_{12}$ |
| $Q_2$ | $Q_{21}$ | $Q_{22}$ |
| h | $h_1$ (=0) | $h_2$ |

The coefficient $h_2$ is so selected that the focal plane is rotated through $\Delta\theta$ from $l_2$ to $l_1$. Hence, the focal plane $l_1$ is maintained at the position $l_1$ whether the operation mode is the high-resolution mode or the wide mass range mode. Thus, it is possible to cope with the two modes with the fixed ion detector 4.

While the invention has been particularly shown and described with reference to preferred embodiments thereof, it will be understood by those skilled in the art that various changes and modifications may be made. For instance, the invention can be applied to a mass spectrometer in which an ion source, a magnetic sector, an electric field, and an ion detector are disposed in this order. In this case, each lens can be disposed either between the magnetic sector and the electric field or between the electric field and the ion detector. In brief, each lens is mounted between the magnetic sector and the ion detector. Further, the quadrupole lenses can be replaced by Einzel lenses. In addition, the quadrupole lenses and the sextupole lens are not limited to the electrostatic type. For example, magnetic field lenses may also be used.

Having thus described my invention with the detail and particularity required by the Patent Laws, what is desired and claimed to be protected by Letters Patent is set forth in the following claims.

What is claimed is:

1. A mass spectrometer capable of multiple simultaneous detection, comprising:

an ion source;

a double focusing mass analyzer which includes at least an electric field and a magnetic sector and into which ions produced by the ion source are introduced;

a two-dimensional ion detector along a focal plane of the mass analyzer for simultaneously detecting ions which are focused and dispersed by the mass analyzer according to mass-to-charge ratio;

two quadrupole lenses disposed in series in the ion path between the magnetic sector and the ion detector;

a lens magnitude-varying means for causing the quadrupole lenses to assume different ones of predetermined sets of magnitudes such that the intersection of the central orbit of ions and the ion focal plane is not moved, irrespective of changes in the magnitudes of the lenses; and a rotating mechanism for rotating the two-dimensional ion detector about the intersection.

2. A mass spectrometer capable of multiple simultaneous detection, comprising:

an ion source;

a double focusing mass analyzer which includes at least an electric field and a magnetic sector and into which ions produced by the ion source are introduced;

a two-dimensional ion detector along a focal plane of the mass analyzer for simultaneously detecting ions which are focused and dispersed by the mass analyzer according to mass-to-charge ratio;

two quadrupole lenses disposed in series in the ion path between the magnetic sector and the ion detector;

a lens magnitude-varying means for causing the quadrupole lenses to assume different ones of predetermined sets of magnitudes such that the intersection of the central orbit of ions and the ion focal plane is not moved, irrespective of changes in the magnitudes of the lenses;

a sextupole lens disposed in the ion path between the magnetic sector and the ion detector; and a means for varying the magnitude of the sextupole lens to make the focal plane coincident with the ion detector irrespective of changes in the magnitudes of the quadrupole lenses.

* * * * *

UNITED STATES PATENT AND TRADEMARK OFFICE

CERTIFICATE OF CORRECTION

PATENT NO. : 4,998,015

DATED : March 5, 1991

INVENTOR : Morio Ishihara

It is certified that error appears in the above-identified patent and that said Letters Patent is hereby corrected as shown below:

Column 1 Line 23 "(" should read --l--.

Column 2 Line 39 after "FIG." insert --1--.

Column 2 Line 54 "11" should read --$l_1$--.

Column 4 Line 44 "1' " should read --l--.

Column 4 Line 45 after "plane" insert --l--.

Signed and Sealed this

First Day of September, 1992

*Attest:*

DOUGLAS B. COMER

*Attesting Officer*

*Acting Commissioner of Patents and Trademarks*